US006360637B1

(12) United States Patent
Weinraub

(10) Patent No.: US 6,360,637 B1
(45) Date of Patent: Mar. 26, 2002

(54) TOOL FOR OPENING A LOCKED VEHICLE DOOR AND METHOD OF MAKING SAME

(75) Inventor: Adam S. Weinraub, Orange, CA (US)

(73) Assignee: Weinraub Enterprises, Inc., Orange, CA (US)

( * ) Notice: Subject to any disclaimer, the term of this patent is extended or adjusted under 35 U.S.C. 154(b) by 0 days.

(21) Appl. No.: 09/713,964

(22) Filed: Nov. 15, 2000

(51) Int. Cl.[7] ..... B25B 33/00
(52) U.S. Cl. ..... 81/488; 81/15.9
(58) Field of Search ..... 81/488, 15.9

(56) References Cited

U.S. PATENT DOCUMENTS

| | | | | | |
|---|---|---|---|---|---|
| 2,027,009 | A | * | 1/1936 | Wyscaver | 81/15.9 |
| 2,885,917 | A | * | 5/1959 | Smith | 81/15.9 |
| 3,438,290 | A | * | 4/1969 | Konopacki | 81/15.9 |
| 4,655,102 | A | * | 4/1987 | Parkins | 81/15.9 |
| 4,683,783 | A | | 8/1987 | Fanberg | |
| 4,683,786 | A | * | 8/1987 | Fanberg | 81/15.9 |
| 4,706,525 | A | * | 11/1987 | Fenner | 81/15.9 |
| 4,873,897 | A | * | 10/1989 | Williams | 81/15.9 |
| 4,882,954 | A | * | 11/1989 | Selby | 81/15.9 |
| 5,440,954 | A | * | 8/1995 | Stevens | 81/15.9 |
| 5,642,648 | A | * | 7/1997 | Wendt et al. | 81/15.9 |

* cited by examiner

*Primary Examiner*—Joseph J. Hail, III
*Assistant Examiner*—David B. Thomas
(74) *Attorney, Agent, or Firm*—Harold L. Jackson

(57) ABSTRACT

A rod having bends to facilitate engaging a vehicle door locking mechanism including at least one flat surface lying in the plane of the bends. To increase efficiency, the portion of the tool engaging the locking mechanism can be gnarled. The cross section of the tool can have two flat sides opposing one another. As the tool is inserted into the door, the flat sides allow for less pressure on the door, seal, and window than other comparable tools having a substantially circular cross section. Furthermore, the rod remains at a sufficient thickness to be manipulated within the door and still transfer the force necessary to unlock the door. The tool is made by a process of cutting a rod to a desired length, grinding at least one side flat, bending the rod to a desired shape in the same plane as the ground side, and heat treating the tool.

32 Claims, 2 Drawing Sheets

TOOL FOR OPENING A LOCKED VEHICLE DOOR AND METHOD OF MAKING SAME

BACKGROUND OF THE INVENTION

1. Field of the Invention

This invention relates to a tool for opening a locked vehicle door and to the method of making the tool.

2. Description of the Prior Art

On occasion, a person may be locked out of their vehicle. This can occur for reasons such as the keys being left inside the vehicle, a key breaking off in the lock, or a malfunction in an electronic door locking mechanism. When this happens it is necessary to have the door unlocked by other means. Usually this requires calling for assistance and waiting for a response. When assistance does arrive two important factors to consider are the time it takes to unlock the vehicle and the potential damage to the car. What is needed is a tool that is quick and easy to use and does as little damage to a vehicle as possible.

Tools for opening locked vehicle doors are well known and have been in use for a long time. They run the range from a simple bent coat hanger to highly specialized tools such as those formed for a specific vehicle type and model year. While a dealer may have access to a set of keys for a particular type of vehicle, it is not always practical to call a dealer at every occasion when a vehicle door is locked. More often, an automotive repair service, locksmith, or law enforcement officer responds to such situations and uses tools designed for insertion into the door of the vehicle and interface with the internal locking mechanism to unlock the door.

Typically the individuals using such tools have some knowledge of the locking mechanism of a vehicle and some training in using specialized tools in unlocking vehicle doors. As such, it is necessary to have a simple and effective unlocking tool that allows the user to unlock a door in a short time thus allowing the user to proceed to assist others. Such tools vary widely in style and dimensions. One such tool is basically a wire type rod that is shaped to effectively interact with a door's locking mechanisms. This is a popular style, but has disadvantages.

A rod designed for use to open a locked door must be strong enough to engage a locking mechanism and transport enough force to unlock the door. Depending upon the type of locking mechanism, the force may be exerted left, right, up, or down on the rod. This usually requires the rod to be of a material, such as steel, that can withstand such forces and to be of a sufficient thickness so as not to permanently deform in use. This poses a significant problem that is best illustrated by describing the process of using the rod.

To begin, the rod is inserted between the door and window. This area usually has a weather seal that is mounted on the inside of the door and engages the window. As a result, the rod is forced against the window. Due to the increased quality in weather stripping and outside surface of the glass window, what little area that may have existed in older model cars between the glass and weather strip has decreased significantly.

Next, the user must move the rod to locate the exact point at which the rod must come into contact with the locking mechanism for opening the door. However, the force needed to move the rod to its required position due to the seal requires a rod with a diameter large enough to withstand the force without deforming. Also, this movement increases the forces that are already placed on the door and window. This can cause scratches on the glass, damage to the seal, and may cause the window to shatter.

Finally, once the user has situated the rod, the user must exert force on the rod to unlock the door. The direction of the force depends upon the type of vehicle locking mechanism. If the rod is not in the right location, due for example to the forces associated with the seal on the rod making the rod less responsive for the user, then the use of force may damage the locking mechanism.

The rod is generally composed of a substance that is flexible and can transmit force without substantial deformation of its general shape. This is most often a variety of spring steel. Such a rod has a substantially circular cross section.

When inserted between a vehicle door and window, a rod with a substantially circular cross section must occupy a space between the seal and window approximately equal to the rod's diameter from its point of contact on the door to its point of contact on the window. Usually there is a weather stripping or seal that fits between the door and the window. As the diameter of the rod increases, it becomes immediately apparent that at some point the diameter can become so large that it may not fit between the door and window or may exert an unacceptable amount of pressure on the door and window due to the seal. This pressure may damage the door, seal, and window and may also serve to inhibit the movement of the rod due to the friction between the rod, door, seal, and window. Such inhibited movement can make detection of the proper positioning of the rod within the door difficult and prone to erroneous placement.

One device has been used to overcome some, but not all, of these disadvantages. The device has a small portion of the rod flattened, not ground or sanded, on opposing sides so that this small portion of the rod can be inserted between the weather stripping and window on the inside of the vehicle. The remaining portion of the rod is round, which creates the same problems for interacting with the outside window and outside weather stripping as described above. Furthermore, this device is not made of steel and is not heat treated to provide the requisite resilience.

While this tool does address the force between the weather stripping and inside window, it does nothing to reduce the force on the outside weather stripping and outside window surface. Also, this tool does not address the strength of the tool for manipulating the locking mechanism or the knurled potion to facilitate engaging the mechanism.

What is needed is a tool that is thin enough to be easily inserted between the weather strip and the window, readily maneuverable within the door, and yet strong enough to transfer enough force to open the door locking mechanism. The present invention accomplishes these goals.

SUMMARY OF THE INVENTION

The invention is directed to a tool for use in unlocking a vehicle door. The tool is comprised of a rod bent into a shape that is useful for engaging a locking mechanism to unlock a vehicle door. Initially, the cross-sectional shape of the rod can vary, however for the purposes of this invention the cross-sectional shape is substantially of the form of a circle or ellipse. Two opposing surfaces of the rod are flat and the flat surfaces are in the same plane as the bends in the rod.

The opposing flat sides can extend substantially the length of the rod or the entire length of the rod. Substantially the length of the rod, or substantially the length of the vehicle unlocking apparatus, means that the flat surfaces need only be along the length of the portion of the rod, or apparatus, that comes into contact with the door seal and window. The rest of the length of the rod, or apparatus, could be of a different shape to accommodate, for example, a variety of handles. The flat surfaces could extend the full length of the rod in which case the handle of the rod, or apparatus, also includes the flat surfaces.

The portion of the rod that engages the locking mechanism can include a gnarled surface. A gnarled surface includes any type of roughened surface or any surface texture that is not smooth.

The rod is made of a material such as spring steel that can be manipulated and still transmits enough force to open a locking mechanism. Any material that is resilient, can substantially retain its shape, is flexible, and can transmit enough force to open a locking mechanism can be used.

The tool for opening a locked vehicle can be made by first selecting a rod of a generally circular cross section such that it can be bent into a shape that can interface with a specific locking mechanism. The rod has a first and second opposing end and the rod is ground down on two opposing sides. When the rod initially has a substantially circular cross-section the ground rod has two opposing flat sides and two opposing semi-circular sides. A rod of about 0.156 inches diameter where two opposing sides have been ground down to about 0.010 inches each is representative of a more efficient rod for use as a vehicle unlocking apparatus. However, a range of 0.140 to 0.190 inches provides adequate strength. Next, the rod is bent into a shape that will allow the user to manipulate a specific locking mechanism. After bending, if the rod is composed of a sufficiently resilient material such that it can be used without further hardening, then the rod can be utilized at this stage. However, if the rod were composed of a material that can be hardened to a desired resiliency, then the rod would be heat-treated to obtain the desired hardness. Where the rod has a gnarled portion, the gnarl can be present before the rod is ground or the gnarl can be added before the tool is through production. Finally, the rod can be coated with a material such as nickel or zinc.

The rod is comprised of bends and a flat surface on only one side of the rod. The flat surface is in the same plane as the bends.

DETAILED DESCRIPTION OF THE INVENTION

The present invention may best be understood by reference to the following description taken in conjunction with the accompanying drawings.

Figures 1, 4, 8:
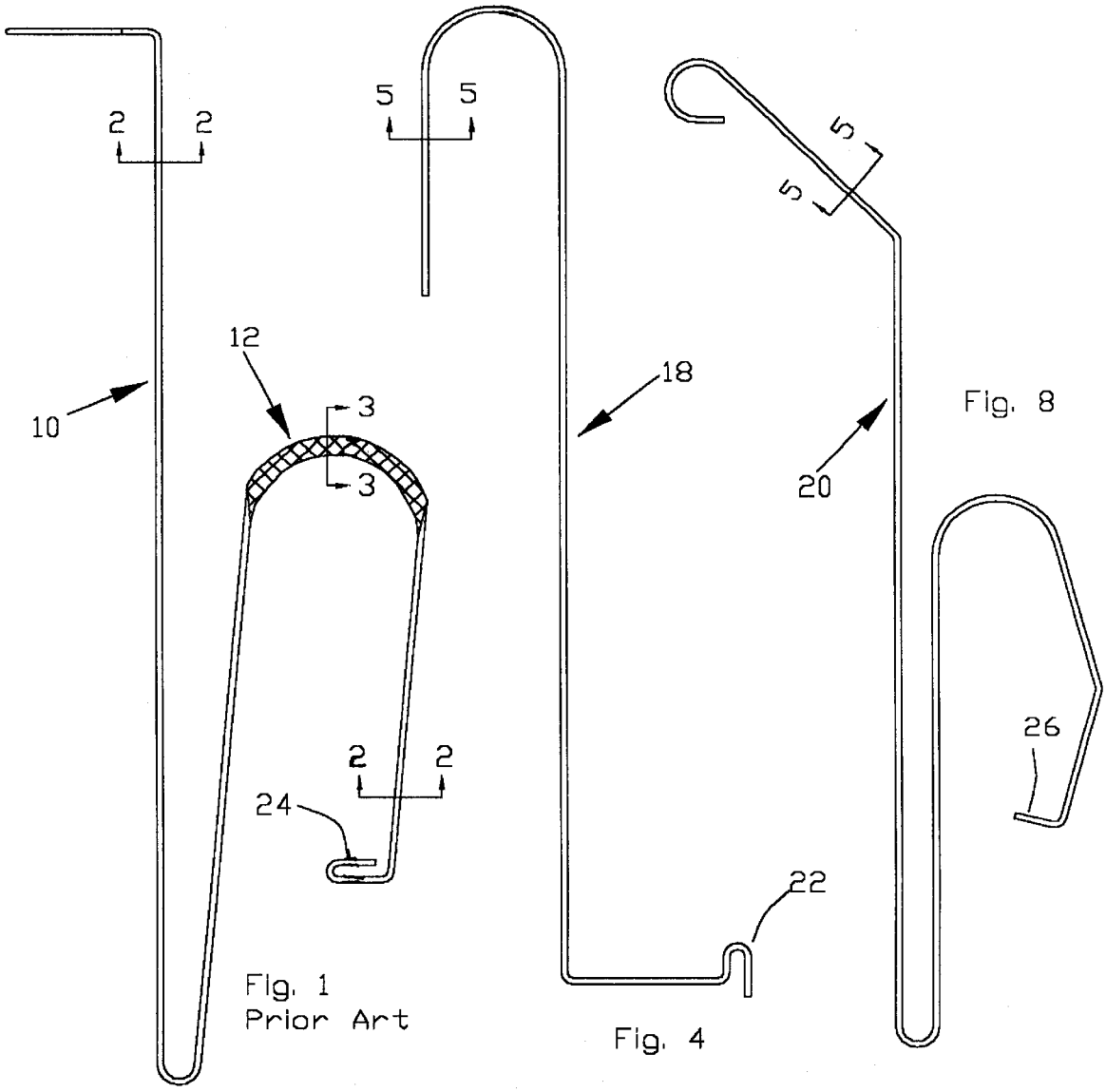
Fig. 1 Prior Art
FIG. 1 is a front view of a prior art lock-opening tool having opposed flat sides on a small portion of the rod.
FIG. 4 is a front view of a lock opening rod in accordance with the present invention; which is bent into a configuration to engage a vehicle locking mechanism.
FIG. 8 is a front view of another type of vehicle door unlocking tool.
Figure 2:
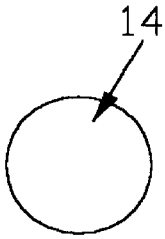
FIG. 2 is a cross-sectional view taken along lines 2—2 of FIG. 1.
Figure 3:
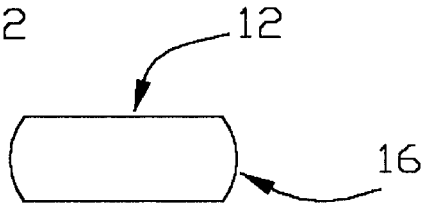
FIG. 3 is a cross-sectional view taken along lines 3—3 of FIG. 1.

FIG. 1 illustrates a prior art tool 10 currently used that has a small portion of one of the bends of the rod flattened on opposing sides 12 as indicated between lines 3—3 and shown in FIG. 3 and having two opposing convex sides 16. This small portion of the rod is designed to engage the inside weather stripping and inside window of a car door. The rest of the rod has a circular cross-section between lines 2—2 and as is shown in FIG. 2 and identified as 14. The lock engaging portion of the rod 24 is used to unlock the door.

The present invention is formed by starting with a rod of a substantially circular cross section 14 (FIG. 2). The rod is ground or sanded to obtain two opposing flat sides 12 as identified along lines 5—5 and shown in FIG. 5 thus retaining two opposing convex sides 16. The rod is then bent into a shape that allows a user to engage a vehicle locking apparatus. One such shape is illustrated in FIG. 4 and identified as 18 with the bends in the rod being in the same, plane as the opposing flat surfaces, see FIG. 7.

Figure 5:
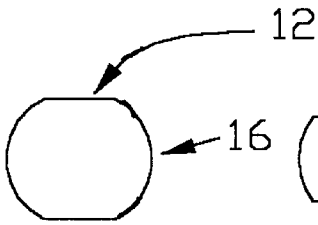
FIG. 5 is a cross-sectional view taken along lines 5—5 of FIG. 4. Showing two opposing sides which have been ground or sanded.

Another such shape is exhibited in FIG. 8 and identified as 20. Again, the rod is ground or sanded to obtain two opposing flat sides 12 as shown in FIG. 5 thus retaining two opposing convex sides 16. In operation, the lock engaging portion 26 is used to unlock the door.

Figure 6:
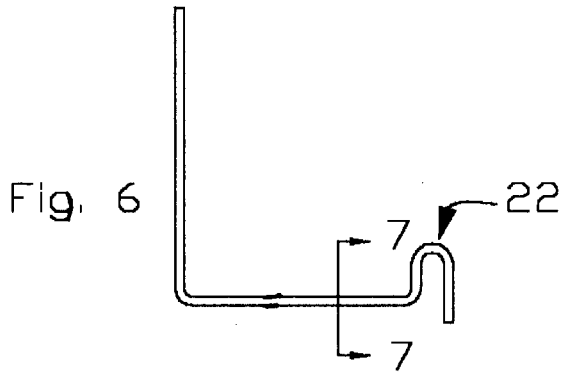
FIG. 6 is a side view of the lower portion of the rod of FIG. 4 that engages the locking mechanism.
Figure 7:
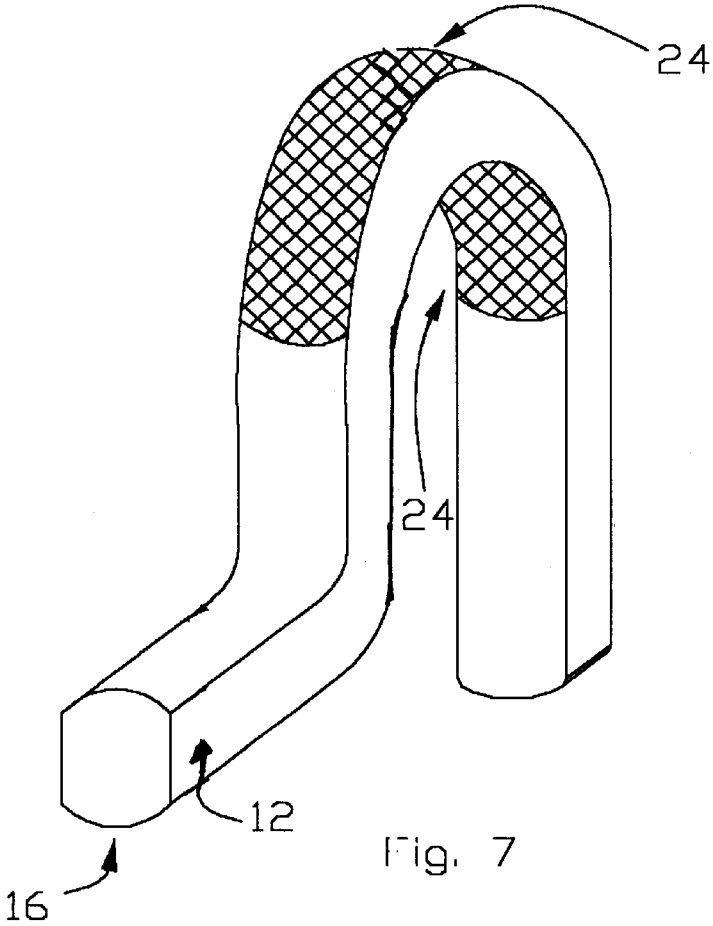
FIG. 7 is an enlarged perspective view taken between the lines 7—7 of FIG. 6 showing the gnarled portion of the rod.

Part of the bent rod of FIG. 4 includes a surface that is adapted to manipulate the locking mechanism 22, see that portion of FIG. 6 viewed along lines 7—7. To increase the effectiveness of the tool, the part of the tool that engages the locking mechanism can have a gnarled surface 24 as indicated in FIG. 7. This gnarled surface can be an inherent part of the rod before any grinding or sanding is performed or it can be added during the process of making the tool.

Once the rod is ground, bent, and optionally gnarled it can then be heat-treated to achieve a desired resilience. In the case where the rod is made of a resilient material such as spring steel, no such heat-treating would be necessary.

While the present invention has been described in regards to a preferred embodiment, it is understood that various modifications may be made by those skilled in the art without departing from the scope or spirit of the invention as identified in the appended claims.

What is claimed is:

1. A tool for opening a locked vehicle door comprising:

a rod having bends in a shape to facilitate engaging a vehicle door locking mechanism for unlocking said vehicle door locking mechanism, the rod having a first and second flat surfaces which extend substantially the length of the rod, the first and second flat surfaces being opposite each other and being in the same plane as the bends in the rod.

2. The tool for opening a locked vehicle door as claimed in claim 1 wherein the first flat surface and the second flat surface extend the full length of the rod.

3. The tool for opening a locked vehicle door as claimed in claim 1 wherein the portion of the vehicle unlocking apparatus that engages the locking mechanism is gnarled.

4. A tool for opening a locked vehicle door comprising:

a rod having a first flat surface and second flat surface, the first and second flat surfaces extending substantially the length of, and on opposite sides of, the rod;

the rod having bends therein in a shape to facilitate engaging a vehicle door locking mechanism for unlocking said vehicle door locking mechanism;

the first and second flat surfaces being in the same plane as the bends in the rod; and the rod being adapted for insertion into the vehicle door such that the bends in the rod are substantially parallel to the plane of the vehicle door when the rod is inserted into the vehicle door.

5. The tool for opening a locked vehicle door as claimed in claim 4 wherein the first flat surface and the second flat surface extend the full length of the rod.

6. The tool for opening a locked vehicle door as claimed in claim 4 wherein the rod is composed of spring steel.

7. The tool for opening a locked vehicle door as claimed in claim 4 wherein the portion of the vehicle unlocking apparatus that engages the locking mechanism is gnarled.

8. A method of producing a tool for opening a locked vehicle door comprising the steps of:

cutting a steel rod to a selected length;

grinding a first flat surface and a second flat surface extending substantially the length of the rod wherein the first and second flat surfaces are disposed opposite each other;

bending the rod; and heat treating the rod.

9. The method of producing a tool for opening a locked vehicle door as claimed in claim 8 further comprising the step of applying a plating to the rod.

10. The method of producing a tool for opening a locked vehicle door as claimed in claim 8 further comprising the step of applying a nickel plating to the rod.

11. The method of producing a tool for opening a locked vehicle door as claimed in claim 8 further comprising the step of grinding the first flat surface and the second flat surface extend the full length of the rod.

12. The method of producing a tool for opening a locked vehicle door as claimed in claim 8 further comprising the steps of:

selecting a rod having a circular cross-section and a center and a surface of approximately 0.156 inch in diameter; and grinding the first flat surface approximately 0.010 inch from the surface of the rod toward the center of the rod substantially the length of the rod; and grinding the second flat surface approximately 0.010 inch from the surface of the rod toward the center of the rod substantially the length of the rod.

13. The method of producing a tool for opening a locked vehicle door as claimed in claim 8 further comprising the steps of:

selecting a rod having substantially the form of a wire and a circular cross-section and a center and a surface and being approximately 0.156 inch in diameter; and grinding the first flat surface approximately 0.010 inch from the surface of the rod toward the center of the rod the length of the rod; and grinding the second flat surface approximately 0.010 inch from the surface of the rod toward the center of the rod the length of the rod.

14. The method of producing a tool for opening a locked vehicle door as claimed in claim 8 further comprising the step of gnarling the rod.

15. A method of producing a tool for opening a locked vehicle door comprising the steps of:

cutting a rod to a selected length;

grinding a first flat surface and a second flat surface extending substantially the length of the rod wherein the first and second flat surfaces are disposed opposite each other; and bending the rod.

16. The method of producing a tool for opening a locked vehicle door as claimed in claim 15 wherein the rod comprises a first end and a second end the second end comprising a lock engaging portion and the rod is gnarled substantially the length of the second end.

17. The method of producing a tool for opening a locked vehicle door as claimed in claim 15 wherein the rod comprises a first end and a second end the second end comprising a lock engaging portion and the rod is gnarled less than substantially the length of the second end.

18. A tool for opening a locked vehicle door comprising:

a rod having bends in a shape to facilitate engaging a vehicle door locking mechanism for unlocking said vehicle door locking mechanism, the rod having a flat surfaces which extend substantially the length of the rod, the flat surfaces being in the same plane as the bends in the rod.

19. The tool for opening a locked vehicle door as claimed in claim 18 wherein the flat surface extends the full length of the rod.

20. The tool for opening a locked vehicle door as claimed in claim 18 wherein the portion of the vehicle unlocking apparatus that engages the locking mechanism is gnarled.

21. A tool for opening a locked vehicle door comprising:

a rod having a flat surface extending substantially the length of the rod;

the rod having bends therein in a shape to facilitate engaging a vehicle door locking mechanism for unlocking said vehicle door locking mechanism;

the flat surface being in the same plane as the bends in the rod; and the rod being adapted for insertion into the vehicle door such that the bends in the rod are substantially parallel to the plane of the vehicle door when the rod is inserted into the vehicle door.

22. The tool for opening a locked vehicle door as claimed in claim 21 wherein the flat surface extends the full length of the rod.

23. The tool for opening a locked vehicle door as claimed in claim 21 wherein the rod is composed of spring steel.

24. The tool for opening a locked vehicle door as claimed in claim 21 wherein the portion of the vehicle unlocking apparatus that engages the locking mechanism is gnarled.

25. A method of producing a tool for opening a locked vehicle door comprising the steps of:

cutting a rod to a selected length;

grinding a flat surface extending substantially the length of the rod; and bending the rod.

26. The method of producing a tool for opening a locked vehicle door as claimed in claim 25 further comprising the step of applying a plating to the rod.

27. The method of producing a tool for opening a locked vehicle door as claimed in claim 25 further comprising the step of applying a nickel plating to the rod.

28. The method of producing a tool for opening a locked vehicle door as claimed in claim 25 further comprising the step of heat treating the rod.

29. A method of producing a tool for opening a locked vehicle door comprising the steps of:

gnarling a rod;

cutting the rod to a selected length;

grinding a flat surface extending substantially the length of the rod; and bending the rod.

30. The method of producing a tool for opening a locked vehicle door as claimed in claim 29 further comprising the step of applying a plating to the rod.

31. The method of producing a tool for opening a locked vehicle door as claimed in claim 29 further comprising the step of applying a nickel plating to the rod.

32. The method of producing a tool for opening a locked vehicle door as claimed in claim 29 further comprising the step of heat treating the rod.

* * * * *